US009595746B2

(12) United States Patent
Sumiyosi et al.

(10) Patent No.: US 9,595,746 B2
(45) Date of Patent: Mar. 14, 2017

(54) SEMI-COAXIAL RESONATOR COMPRISED OF COLUMNAR SHAPED RESONANT ELEMENTS WITH SQUARE SHAPED PLATES, WHERE VERTICAL SCREW HOLES ARE DISPOSED IN THE SQUARE SHAPED PLATES

(71) Applicant: Nokia Solutions and Networks Oy, Espoo (FI)

(72) Inventors: Takasi Sumiyosi, Kadoma (JP); Minoru Tachibana, Yokohama (JP)

(73) Assignee: Nokia Solutions and Networks Oy, Espoo (FI)

( * ) Notice: Subject to any disclaimer, the term of this patent is extended or adjusted under 35 U.S.C. 154(b) by 0 days.

(21) Appl. No.: 14/430,943

(22) PCT Filed: Jul. 18, 2013

(86) PCT No.: PCT/JP2013/004404

§ 371 (c)(1),
(2) Date: Mar. 25, 2015

(87) PCT Pub. No.: WO2014/049922

PCT Pub. Date: Apr. 3, 2014

(65) Prior Publication Data

US 2015/0255849 A1 Sep. 10, 2015

(30) Foreign Application Priority Data

Sep. 26, 2012 (JP) ..... 2012-212630

(51) Int. Cl.
*H01P 1/205* (2006.01)
*H01P 7/04* (2006.01)
(Continued)

(52) U.S. Cl.
CPC ..... *H01P 1/2053* (2013.01); *H01P 7/04* (2013.01); *H01P 1/2084* (2013.01); *H01P 7/10* (2013.01)

(58) Field of Classification Search
CPC ..... H01P 1/205; H01P 1/2053; H01P 7/04
(Continued)

(56) References Cited

U.S. PATENT DOCUMENTS 6,198,363 B1 * 3/2001 Vuoppola et al. .... H01P 1/2053 333/202
6,320,483 B1 * 11/2001 Raty et al. ..... H01P 1/2053 333/203
(Continued)

FOREIGN PATENT DOCUMENTS

CN 1367549 A 4/2002
EP 1 227 535 A1 7/2002
(Continued)

*Primary Examiner* — Benny Lee
(74) *Attorney, Agent, or Firm* — Harrington & Smith

(57) ABSTRACT

Provided is a semi-coaxial resonator that reduces the insertion loss in the pass band and that is made to be compact, lightweight, and low in cost. A resonator is formed by fastening a cylindrical first element with a square and planar second element at an open end (one end) of the first element. A plurality of these resonators are disposed such that the square edges are brought close to each other and the other ends of the first elements are secured to the bottom of a box-shaped case. The open side of the case that accommodates the plurality of resonators is closed by a lid.

8 Claims, 7 Drawing Sheets

(51) Int. Cl.
*H01P 1/208* (2006.01)
*H01P 7/10* (2006.01)

(58) Field of Classification Search
USPC ..... 333/203, 222
See application file for complete search history.

(56) References Cited

U.S. PATENT DOCUMENTS

| | | | | |
|---|---|---|---|---|
| 6,566,984 | B2 * | 5/2003 | Niiranen et al. ..... | H01P 1/2053 333/202 |
| 2002/0097113 | A1 | 7/2002 | Okada et al. ..... | 333/134 |

FOREIGN PATENT DOCUMENTS

| | | | |
|---|---|---|---|
| JP | 58-172003 | | 11/1983 |
| JP | S59-004202 | A | 1/1984 |
| JP | S59-017606 | | 2/1984 |
| JP | S59-139701 | A | 8/1984 |
| JP | 2-35501 | | 3/1990 |
| JP | H02-090504 | | 7/1990 |
| JP | 7-30304 | | 1/1995 |
| JP | 2002-290108 | | 4/2002 |
| JP | 2012-212630 | | 1/2012 |
| KR | 2002-0062584 | A | 7/2002 |

* cited by examiner

SEMI-COAXIAL RESONATOR COMPRISED OF COLUMNAR SHAPED RESONANT ELEMENTS WITH SQUARE SHAPED PLATES, WHERE VERTICAL SCREW HOLES ARE DISPOSED IN THE SQUARE SHAPED PLATES

TECHNICAL FIELD

The present invention relates to a semi-coaxial resonator having an SIR (Stepped Impedance Resonator) structure.

BACKGROUND ART

There is a high demand for a reduction in size, weight, and cost of base stations in mobile communication systems. The base stations use a transmitting filter for transmission and a receiving filter for reception during transmission and reception of radio signals in order to reduce undesired and unnecessary radio frequency waves. These transmitting and receiving filters are band-pass filters and may be collectively called a "filter" in the following description.

The insertion loss in the pass-band in each filter mainly causes degradation of power efficiency in the transmitting filter and causes degradation of noise figure (NF) in the receiving filter. For this reason, it is necessary to minimize the insertion loss in the pass-band in the filters. In order to minimize the insertion loss in the pass-band, high unloaded Q is required in the resonator.

In addition, the weight of the filters occupies about 30% of the weight of the entire base station, and thus has a large influence on the weight of the apparatus.

When a general TEM (Transverse Electro Magnetic) mode air-cavity filter is used, an increase in unloaded Q requires an increase in size of the filter structure, which conflicts with a desired reduction in size and weight. Meanwhile, use of a dielectric filter allows for reduction in size and weight but causes an increase in cost. In this respect, Patent Literature (hereinafter, referred to as "PTL") 1 discloses a semi-coaxial resonator used in a filter that achieves a reduction in size, weight, and cost. Note that, the term "semi-coaxial" refers to a coaxial line having a short-circuited end.

In the resonator disclosed in PTL 1 ($\lambda/4$ air semi-coaxial resonator), the casing (outer conductor) is formed in a box shape, and the open end of a resonator body (inner conductor) housed in the casing is formed in a disk shape, thereby achieving low impedance for wavelength shortening. Thus, a reduction in the height of resonator body and casing (capacity reduction) is achieved.

In general, multiple resonator bodies are used. Thus, FIG. 1 illustrates a state where two resonator bodies are used in the resonator disclosed in PTL 1. As illustrated in FIG. 1, the walls inwardly protruding respectively from side surfaces of the casing are provided between two resonator bodies for the purpose of reducing the electromagnetic field coupling between the two resonator bodies.

CITATION LIST

Patent Literature

PTL 1

Japanese Patent Application Laid-Open No. 58-172003

SUMMARY OF THE INVENTION

Technical Problem

However, for downsizing the resonator using multiple resonator bodies disclosed in PTL 1 mentioned above, the only choices are to reduce the size of the casing or to increase the disc shaped open end of each of the resonator bodies, and either way reduces the distance between the walls and resonator bodies, thus hindering the flow of current and resulting in degradation of unloaded Q. For this reason, a problem arises in that the insertion loss in the pass-band cannot be minimized.

An object of the present invention is to provide a semi-coaxial resonator that minimizes the insertion loss in the pass-band and that achieves a reduction in size, weight, and cost.

Solution to the Problem

A semi-coaxial resonator according to the present invention includes: a resonator body including a columnar shaped first element and a square plate shaped second element that is fastened to one end of the first element; and a box shaped casing, wherein a plurality of the resonator bodies are disposed in the casing while certain sides of the respective squares of the resonator bodies are positioned close to each other.

Advantageous Effects of the Invention

According to the present invention, it is possible to minimize the insertion loss in the band-pass and to achieve a reduction in size, weight, and cost.

DETAILED DESCRIPTION OF THE EMBODIMENT

Hereinafter, an embodiment of the present invention will be described with reference to the drawings.

Figure 1:
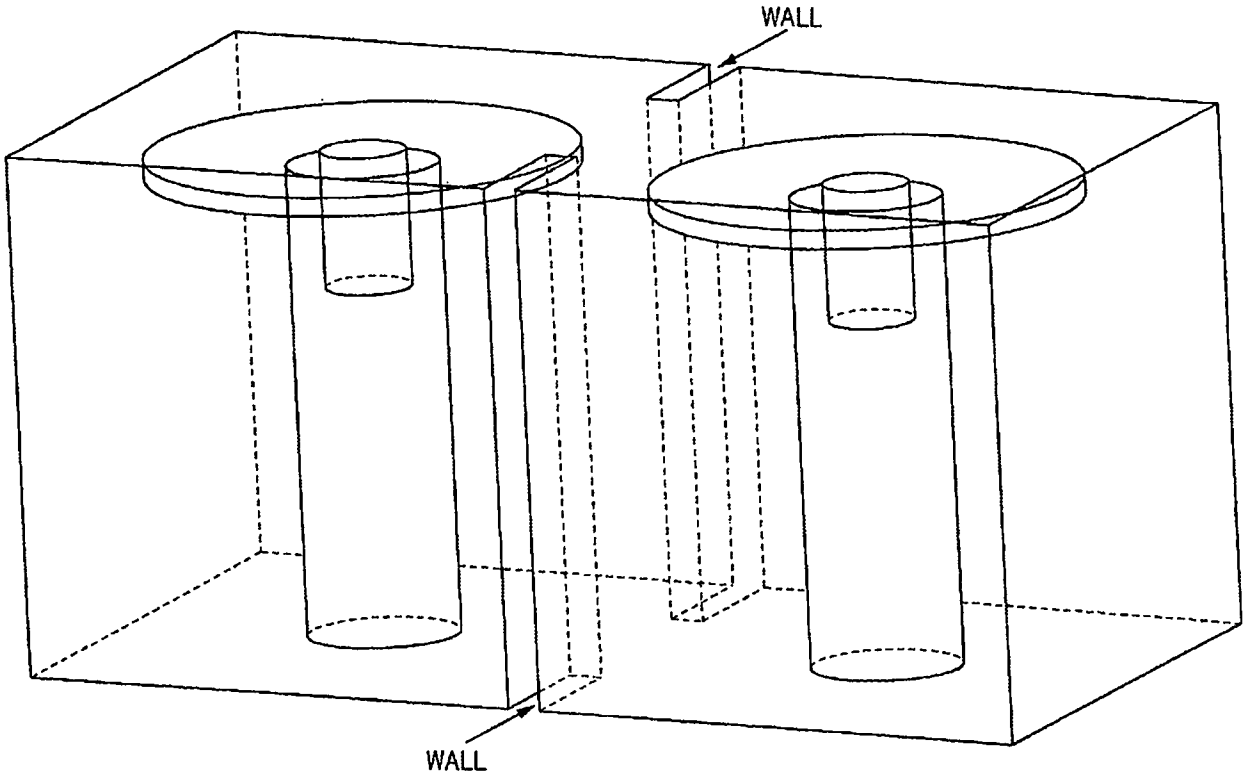
FIG. 1 Prior Art
FIG. 1 is a diagram illustrating two resonator bodies used in a resonator disclosed in PTL 1.
Figure 2:
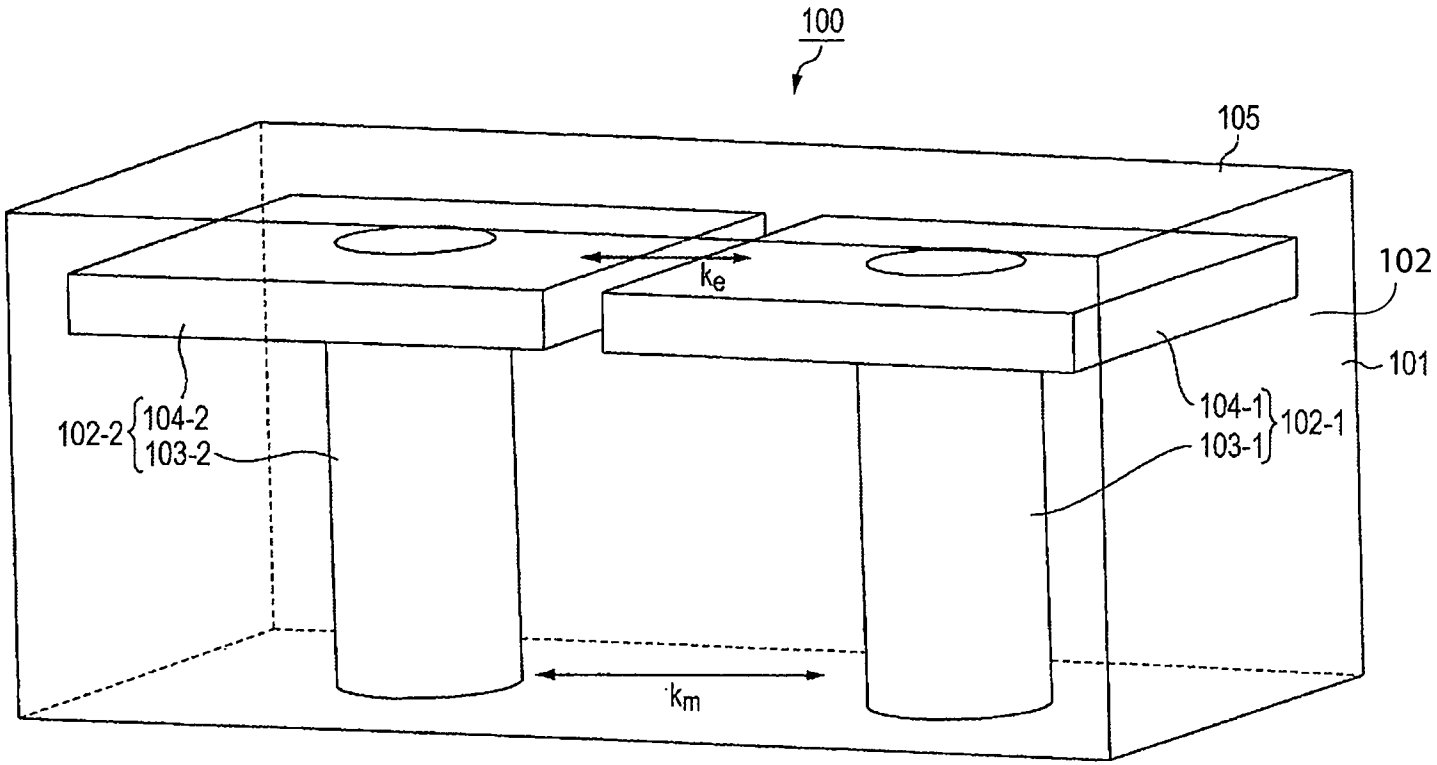
FIG. 2 is a perspective view illustrating a configuration of a semi-coaxial resonator according to an embodiment of the present invention.
Figure 3A:
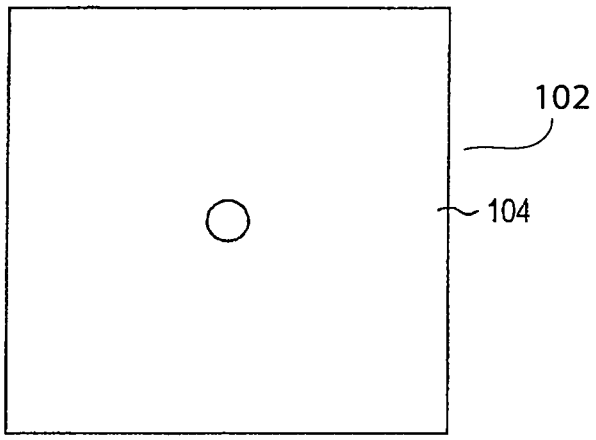
FIG. 3A is a top view of a resonator body partially forming the semi-coaxial resonator.
Figure 3B:
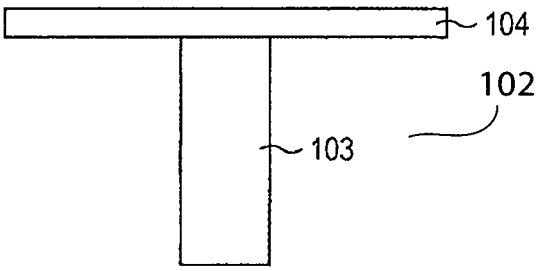
FIG. 3B is a front view (and rear view) of the resonator body.
Figure 3C:
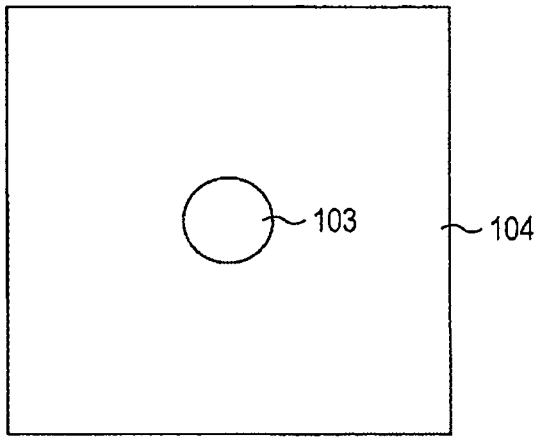
FIG. 3C is a bottom view of the resonator body.

FIG. 2 is a perspective view illustrating a configuration of a semi-coaxial resonator 100 according to an embodiment of the present invention. FIG. 3A is a top view of resonator body 102 partially forming the semi-coaxial resonator 100, FIG. 3B is a front view (and rear view) of resonator body 102, and FIG. 3C is a bottom view of resonator body 102. Hereinafter, the configuration of semi-coaxial resonator 100 will be described using FIG. 2 and FIGS. 3A, 3B, and 3C.

Casing 101 (FIG. 2) made of a metal member such as aluminum or iron has a box shape and houses resonator body 102 also made of a metal member such as aluminum or iron. In FIG. 2, two resonator bodies 102-1 and 102-2 are housed in casing 101 (when an individual resonator body is identified, it is denoted with a suffix number, and when an individual resonator body is not identified, it is denoted by the reference numeral without a suffix number). Casing 101 houses resonator bodies 102-1 and 102-2 and is closed when the open top (top portion in the drawing) of casing 101 is covered by lid 105 made of a metal member.

Resonator body 102-1 includes columnar shaped first element 103-1 (hereinafter, referred to as "high impedance portion") and square plate shaped second element 104-1 that is fastened to the open end of the high impedance portion (hereinafter, referred to as "low impedance portion"). Likewise, resonator body 102-2 includes high impedance portion 103-2 and low impedance portion 104-2 (hereinafter, when an individual high impedance portion and an individual low impedance portion are identified, they are denoted with suffix numbers, and when these individual impedance portions are not identified, they are denoted without suffix numbers).

Both ends of each of high impedance portions 103-1 and 103-2 are provided with screw holes, respectively. One end of each of high impedance portions 103-1 and 103-2 is fastened to the bottom of casing 101 using a screw via a screw hole (not illustrated) provided in the bottom of casing 101 and is thus short-circuited. Meanwhile, the other ends (open ends) of high impedance portions 103-1 and 103-2 are fastened to low impedance portions 104-1 and 104-2 using screws via through holes (not illustrated) provided to the centers of low impedance portions 104-1 and 104-2, respectively.

Two resonator bodies 102-1 and 102-2 are disposed with certain sides of the respective squares of low impedance portions 104-1 and 104-2 facing each other. The high impedance portions form magnetic-field coupling with each other and the low impedance portions form electric-field coupling between the two resonator bodies disposed in the manner mentioned above.

Semi-coaxial resonator 100 having the configuration mentioned above forms capacity (top capacity) between the top surface of low impedance portion 104 (FIGS. 3A, 3B, 3C) of resonator body 102 and lid 105 of casing 101 and resonates at a predetermined center frequency by the reactance component and top capacity of resonator body 102.

Hereinafter, the characteristics of low impedance portion 104 will be described. In semi-coaxial resonator 100 according to the present embodiment, the coupling coefficient by electric-field coupling increases as the distance between the low impedance portions becomes shorter or the length of the sides of the low impedance portions that face each other becomes longer.

In general, coupling coefficient k by the electromagnetic-field coupling between the two resonator bodies is calculated using Equation I below.

(Equation 1)

$$k = \frac{k_m}{1 - k_m k_e} - \frac{k_e}{1 - k_m k_e} \quad [1]$$

In Equation 1, "$k_m$" represents the coupling coefficient by magnetic-field coupling, and "$k_e$" represents the coupling coefficient by electric-field coupling. If $k_m k_e \ll 1$ holds true, Equation 2 below, which is an approximation equation, also holds true.

$$[2] k \approx k_m - k_e \quad \text{(Equation 2)}$$

According to Equation 2, it can be seen that the higher the coupling coefficient by electric-field coupling is, the lower the coupling coefficient by electromagnetic-field coupling is. In semi-coaxial resonator 100, the coupling coefficient $k_e$ by electric-field coupling increases and the coupling coefficient by magnetic-field coupling $k_m$ decreases when the distance between the low impedance portions is reduced or when the sides of the squares of low impedance portions 104 are made longer as depicted in FIG. 2. Thus, providing a wall between the resonator bodies is no longer required, and high unloaded Q can be obtained because the flow of current is no longer hindered by the wall. As a result, the filter using semi-coaxial resonator 100 can minimizes the insertion loss in the pass-band.

In addition, a larger area of the square of low impedance portion 104 brings about a greater wavelength shortening effect and can make high impedance portions (FIGS. 3B and 3C) 103 shorter, which contributes to a reduction in the height of the entirety of semi-coaxial resonator 100. More specifically, making one side of the square of low impedance portion 104—longer to create a rectangle allows high unloaded Q to be obtained and increases the area of the rectangle as a result, so that semi-coaxial resonator 100 can be reduced in height.

As described above, according to the present embodiment, a plurality of resonator bodies each including the columnar shaped first element and the square plate shaped second element fastened to the opening end of the first element are disposed in a box shaped metal casing while certain sides of the respective squares of the resonator bodies are positioned close to each other. Thus, the electric-field coupling between the plurality of resonator bodies is increased, and the magnetic-field coupling $k_m$ can be reduced as a result of the increase in the electric-field coupling. Thus, providing a wall between the plurality of resonator bodies is no longer required, and the flow of current is no longer hindered by the wall, which makes it possible to obtain favorable unloaded Q and to minimize the insertion loss in the pass-band. In addition, since no wall needs to be provided, the area of the square of the second element can be increased, and the wavelength shortening effect obtainable from the increase in the area of the square achieves a reduction in the height of the resonator bodies and resonator. Thus, it is possible to achieve a reduction in size, weight, and cost.

Figure 4:
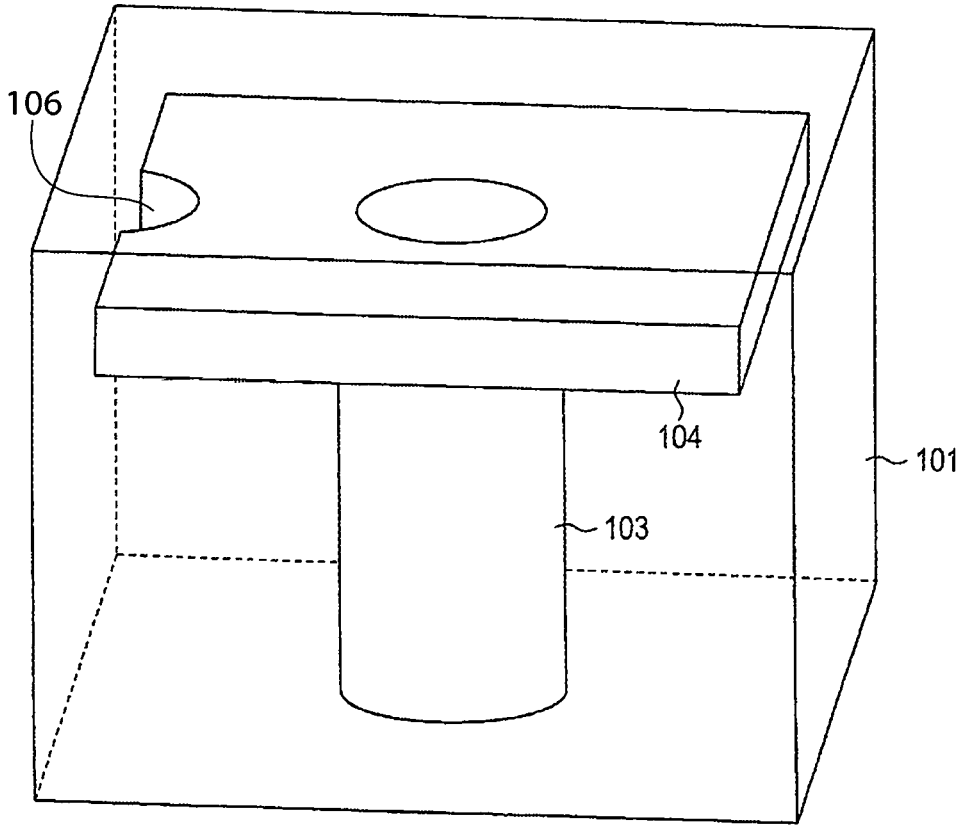
FIG. 4 is a diagram illustrating a screw hole for inserting a screw to adjust the degree of coupling between resonator bodies formed in a side of a low impedance portion.

Note that, a screw hole 106 for inserting a screw to adjust the degree of coupling between resonator bodies may be formed in the sides of the low impedance portions that face each other (see FIG. 4). More specifically, a vertical half of the screw hole 106 is formed in the side of one of the low impedance portions (shown in FIG. 4) and a vertical half of the screw hole 106 is also formed in the side of the other low impedance portion (not shown). The screw hole 106 is thus formed when the vertical halves of the screw hole face each other.

Figure 5:
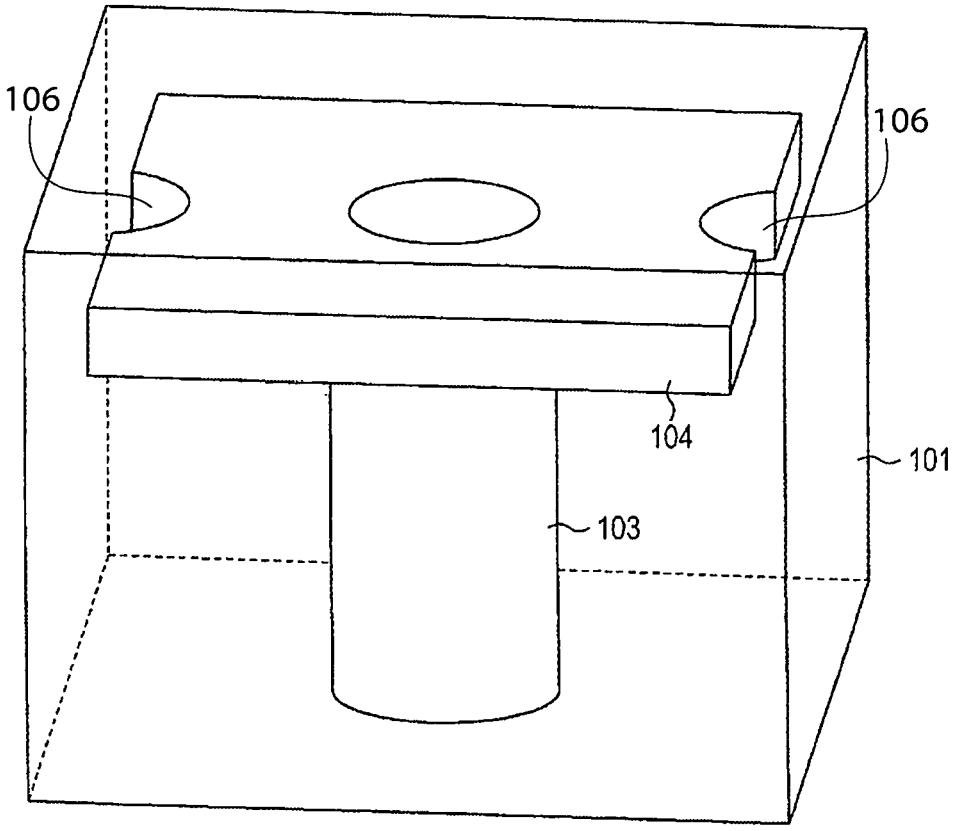
FIG. 5 is a diagram illustrating screw holes for inserting a screw to adjust the degree of coupling between resonator bodies formed respectively in sides of the low impedance portion, the sides being positioned opposite to each other.
Figure 6:
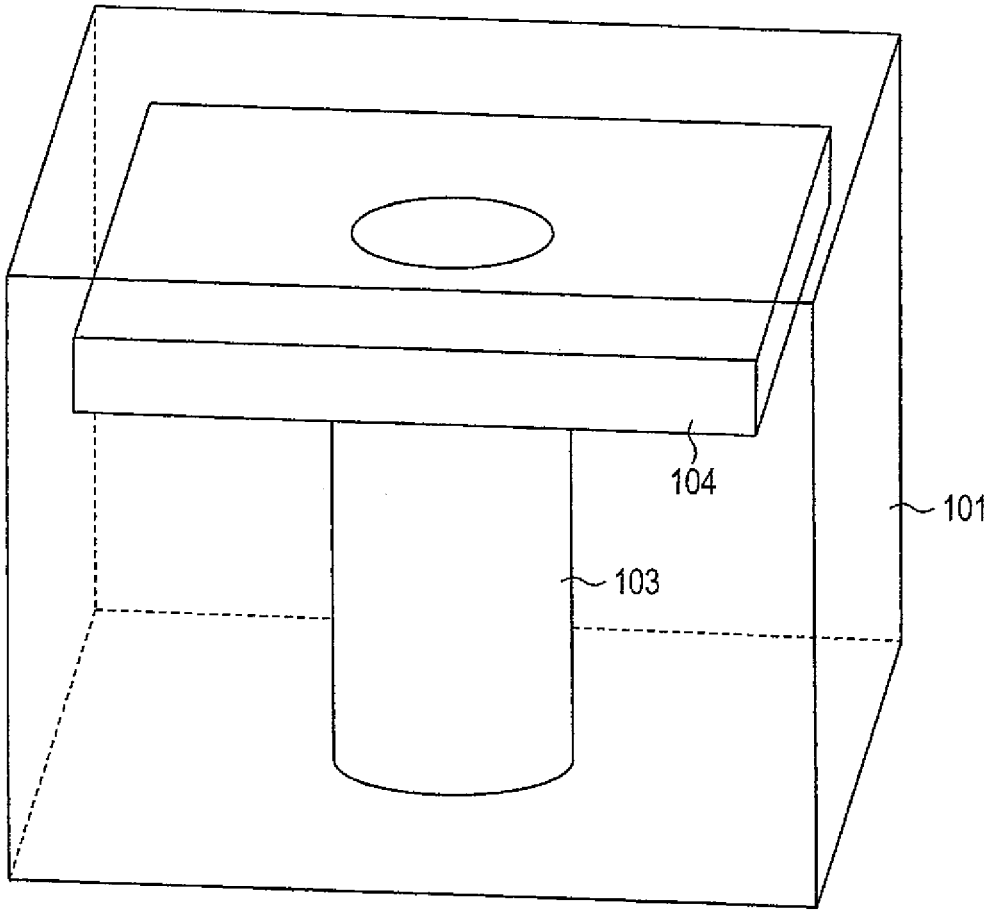
FIG. 6 is a diagram illustrating a resonator body without adjustment of the degree of coupling between resonator bodies.
Figure 7:
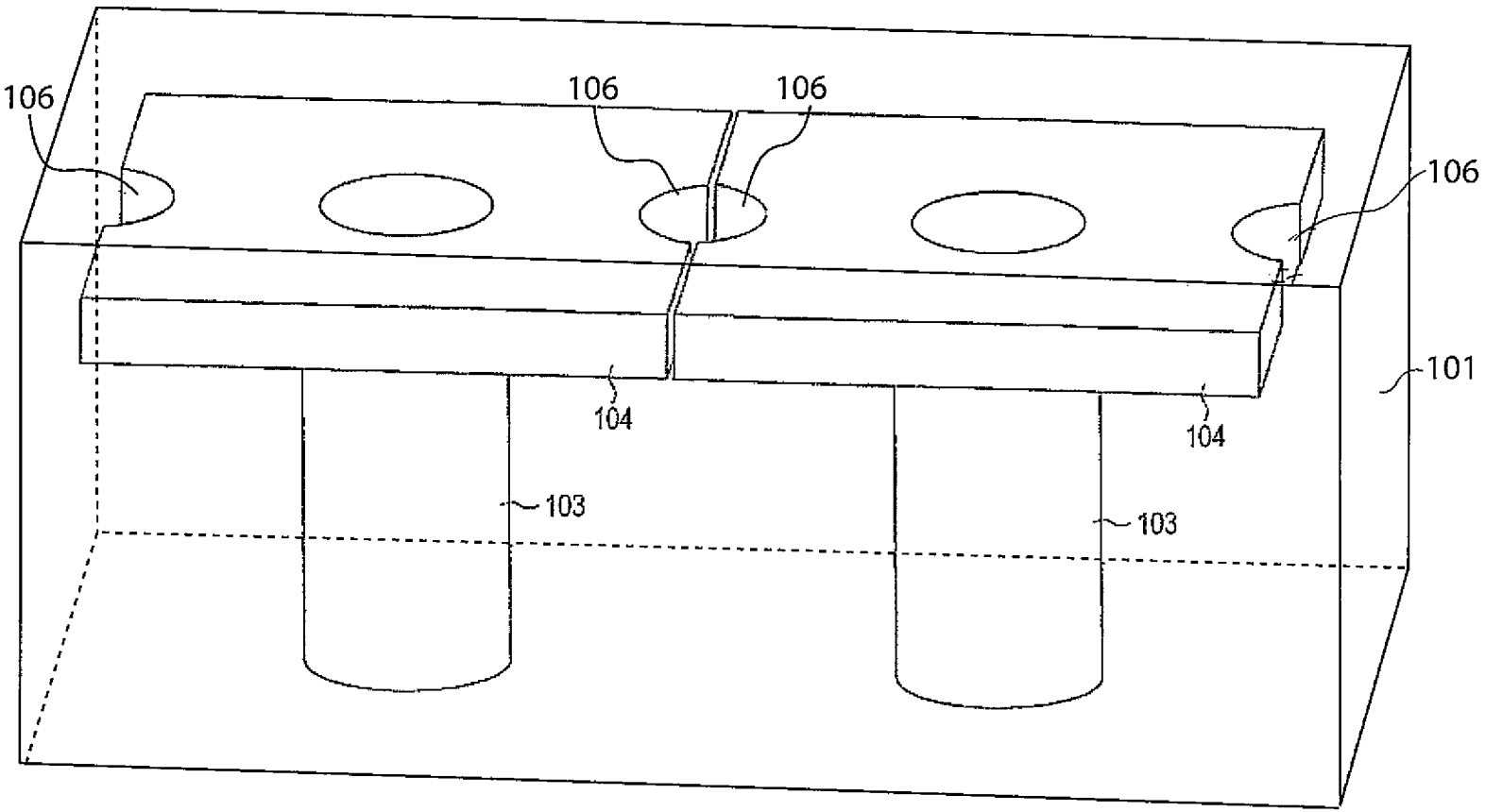
FIG. 7 is a diagram illustrating a first half and a second half of a vertical screw hole together forming the vertical screw hole for receiving a screw to adjust a degree of coupling.

Likewise, when three or more resonator bodies are disposed in line, in a low impedance portion placed between two resonator bodies, the vertical half of the screw hole 106 is formed in each of the two sides of the square of the low impedance portion that are positioned opposite to each other as illustrated in FIG. 5. The screw holes 106 are thus formed by the vertical halves of the screw hole 106 thus formed and the vertical halves of the screw hole 106 formed respectively in the sides of other low impedance portions positioned respectively at opposite sides of the low impedance portion. Note that, the resonator body without adjustment of the degree of coupling between resonator bodies is illustrated in FIG. 6 for reference. This resonator body in FIG. 6 is identical to the resonator bodies illustrated in FIG. 2 and FIGS. 3A to 3C. FIGS. 4, 5 and 6 also show casing 101, high impedance portion 103 and low impedance portion 104. FIG. 7 shows two resonator bodies disposed in a line with a first half and a second half of a vertical screw hole 106 together forming the vertical screw hole 106 for receiving a screw to adjust a degree of coupling.

The disclosure of Japanese Patent Application No. 2012-212630, filed on Sep. 26, 2012, including the specification, drawings and abstract is incorporated herein by reference in its entirety.

INDUSTRIAL APPLICABILITY

The semi-coaxial resonator according to the present invention is applicable to filters or the like of base stations in mobile communication systems.

REFERENCE SIGNS LIST

100. Semi-coaxial resonator
101. Casing
102-1, 102-2 Resonator body
103-1, 103-2 High impedance portion
104-1, 104-2 Low impedance portion
105 Lid

The invention claimed is:

1. A semi-coaxial resonator comprising:
a box shaped casing, and
a plurality of the resonator bodies disposed in the casing, wherein each resonator body of the plurality of resonator bodies includes a columnar shaped first element and a square plate shaped second element that is fastened to one end of the first element, wherein a respective side of the square plate shaped second element of a first resonator body at the plurality of resonator bodies is positioned close to a corresponding side of the square plate of a second resonator body at the plurality of resonator bodies, and wherein the respective side has a first half of a vertical screw hole and the corresponding side has a second half of the vertical screw hole together forming the vertical screw hole for receiving a screw to adjust a degree of coupling between first resonator body and the second resonator body.

2. The semi-coaxial resonator according to claim 1, wherein the box shaped casing comprises a metal member.

3. The semi-coaxial resonator according to claim 1, wherein the box shaped casing has an open top, and further comprising a lid covering the open top of the box shaped casing.

4. The semi-coaxial resonator according to claim 1, wherein each columnar shaped first element has relatively high impedance and an end of each columnar shaped first element opposite the one end is fixed and short-circuited to the casing, and each square plate shaped second element has relatively low impedance.

5. The semi-coaxial resonator according to claim 1, wherein the first resonator body and the second resonator body each has the columnar shaped first element having relatively high impedance and an end of the columnar shaped first element opposite the one end fixed and short-circuited to the casing, and the square plate shaped second element having relatively low impedance; and the first resonator body and the second resonator body are disposed in the casing so that the relatively low impedance plate shaped second element of each one of the two resonator bodies face each other so that the respective relatively high impedance columnar shaped first element of the two resonator bodies form magnetic-field coupling with each other and the respective low impedance plate shaped second element form electric-field coupling between the first resonator body and the second resonator body.

6. A semi-coaxial resonator comprising:
a box shaped casing, wherein
a plurality of the resonator bodies are disposed in the casing, wherein two resonator bodies of the plurality of resonator bodies each has a columnar shaped first element having relatively high impedance and an end of the columnar shaped first element opposite the one end fixed and short-circuited to the casing, and a square plate shaped second element having relatively low impedance and defining a half of a vertical screw hole; and the two resonator bodies are disposed in the casing so that the relatively low impedance plate shaped second element of each one of the two resonator bodies face each other so that the respective relatively high impedance columnar shaped first element of the two resonator bodies form magnetic-field coupling with each other and the respective low impedance plate shaped second element form electric-field coupling between the two resonator bodies, and wherein the half of the vertical screw hole of each of the two resonator bodies are positioned close to and face each other and together form the vertical screw hole for receiving a screw to adjust a degree of coupling between the two resonator bodies.

7. The semi-coaxial resonator according to claim 6, wherein the box shaped casing comprises a metal member.

8. The semi-coaxial resonator according to claim 6, wherein the box shaped casing has an open top, and further comprising a lid covering the open top of the box shaped casing.

* * * * *